US007432863B2

(12) United States Patent
Kim et al.

(10) Patent No.: US 7,432,863 B2
(45) Date of Patent: Oct. 7, 2008

(54) PATCH ANTENNA FOR LOCAL AREA COMMUNICATIONS

(75) Inventors: Yong-jin Kim, Seongnam-si (KR); Young-eil Kim, Suwon-si (KR); Kang-wook Kim, Mokpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/604,773

(22) Filed: Nov. 28, 2006

(65) Prior Publication Data

US 2007/0273588 A1 Nov. 29, 2007

(30) Foreign Application Priority Data

May 24, 2006 (KR) ..... 10-2006-0046366

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 7,132,983 B2 * 11/2006 Gaier ..... 343/700 MS
7,154,441 B2 * 12/2006 Hansen et al. ..... 343/700 MS

FOREIGN PATENT DOCUMENTS

KR 2003-0017214 A 3/2003
KR 10-2004-0052561 A 6/2004

* cited by examiner

*Primary Examiner*—Tan Ho
(74) *Attorney, Agent, or Firm*—Sughrue Mion, PLLC

(57) ABSTRACT

A patch antenna includes a radiator part which includes at least one first radiator attached to an area of one surface of a dielectric, and at least one second radiator disposed within the dielectric and electrically connected to the first radiator; and a ground part which comprises at least one first ground disposed on other surface of the dielectric and at least one second ground disposed on the one surface of the dielectric, the first ground and the second ground electrically connected to each other. Accordingly, the size of the patch antenna is drastically reduced, and a wide bandwidth, high gain, and directionality are obtained.

17 Claims, 4 Drawing Sheets

PATCH ANTENNA FOR LOCAL AREA COMMUNICATIONS

CROSS-REFERENCE TO RELATED APPLICATIONS

This application claims priority from 35 U.S.C. §119 (a) from Korean Patent Application No. 10-2006-0046366 filed on May 24, 2006, in the Korean Intellectual Property Office, the entire disclosure of which is incorporated herein by reference.

BACKGROUND OF THE INVENTION

1. Field of the Invention

Apparatuses consistent with the present invention relate to a patch antenna for local area communications. More particularly, the present invention relates to a patch antenna for local area communications having small size, high gain, wide bandwidth, and directionality.

2. Description of the Related Art

Recent developments of information and communication technology put emphasis on miniaturization and mobility of communication devices. Particularly, a mobile communication device with various functions provides diverse services to users through additional functions such as a wireless Internet access function using WLAN, a digital multimedia broadcasting (DMB) function enabling to view terrestrial or satellite programs, a position recognition function using GPS satellites, a camera, an MP3, and an RFID, in addition to a communication function which is a unique function of the mobile communication terminal.

Among those services, a new technology and service called mobile RFID (mRFID) is developing through the convergence of RFID system and mobile communications. The mRFID technology can read information from an external tag and provide useful information services to a user or forward information from the mobile communication terminal to another device through the tag of the mobile communication terminal, by mounting a tag, a reader, an antenna, and a processing module to a mobile communication terminal.

An RFID antenna adapted to the mRFID technique transmits and receives radio signals of frequency 908.5~914 MHz in Korea and of 2.45 GHz frequency in Europe, whereas an antenna dedicated to communications of the mobile communication terminal transmits and receives radio signals of 850 MHz frequency. There is small difference between the domestic band for the RFID radio signals and the domestic band for the mobile communication radio signals. However, since a mobile communication antenna of a conventional mobile communication terminal uses the narrowband, it is difficult to transmit and receive even the RFID radio signals. Additionally, in Europe, it is more difficult to use one antenna because of the considerable difference between the RFID radio signal band and the mobile communication radio signal band. Thus, to implement the mRFID technique, the conventional mobile communication terminal uses the RFID antenna and the mobile communication antenna that are separately mounted.

However, when the RFID antenna and the mobile communication antenna are provided separately, it is inevitable that the mobile communication terminal will be large. This goes against the trend of current mobile communication terminal advancements, which attempts to miniaturize mobile communication terminals. Therefore, it is necessary to find a solution to avoid enlargement of mobile communication terminals through the miniaturization of RFID antennas.

It is advantageous that the antenna has wide bandwidth and high gain, and that a local area antenna with a specific purpose, such as RFID antenna, has directionality. Therefore, there is demand for an antenna having wide bandwidth, high gain, and directionality.

SUMMARY OF THE INVENTION

The present invention has been provided to address the above-mentioned and other problems and disadvantages occurring in the conventional arrangement, and an aspect of the present invention provides a patch antenna for local area communications with small size, wide bandwidth, high gain, and directionality.

According to an aspect of the present invention, a patch antenna comprises a radiator part which comprises at least one first radiator attached on an area of one surface of a dielectric, and at least one second radiator disposed within the dielectric and electrically connected to the at least one first radiator; and a ground part which comprises at least one first ground disposed on another surface of the dielectric and at least one second ground disposed on the one surface of the dielectric, and the at least one first ground and the at least one second ground electrically connected to each other.

The at least one first radiator and the at least one second radiator may be electrically connected to each other through at least one via hole.

The at least one first ground and the at least one second ground may be electrically connected to each other through at least one via hole.

The at least one first radiator may be disposed at a center area of one side of the dielectric.

The at least one second radiator may comprise a pair of conducting plates facing either side of the at least one first radiator.

The at least one first ground may be formed in size corresponding to the other surface of the dielectric.

The at least one second ground may comprise of a pair conducting plates which are spaced from the at least one first radiator by a certain distance and disposed on both sides of the at least one first radiator.

Each of the via holes may connect an end region of the at least one first radiator facing the at least one second ground to an end region facing the at least one first radiator of the conducting plates which construct the at least one second radiator.

The at least one via hole may connect both end regions of the at least one first ground to an outer end region of the conducting plates which construct the at least one second ground.

The radiator part and the ground part may receive power from probes, respectively.

The at least one first radiator and the at least one second radiator may be electrically connected to each other through a conducting plate.

The at least one first ground and the at least one second ground may be electrically connected to each other through a conducting plate.

BRIEF DESCRIPTION OF THE DRAWING FIGURES

These and/or other aspects of the present invention will become more apparent and more readily appreciated from the following description of exemplary embodiments thereof, with reference to the accompanying drawings, in which.

DETAILED DESCRIPTION OF THE EXEMPLARY EMBODIMENTS

Figure 1:
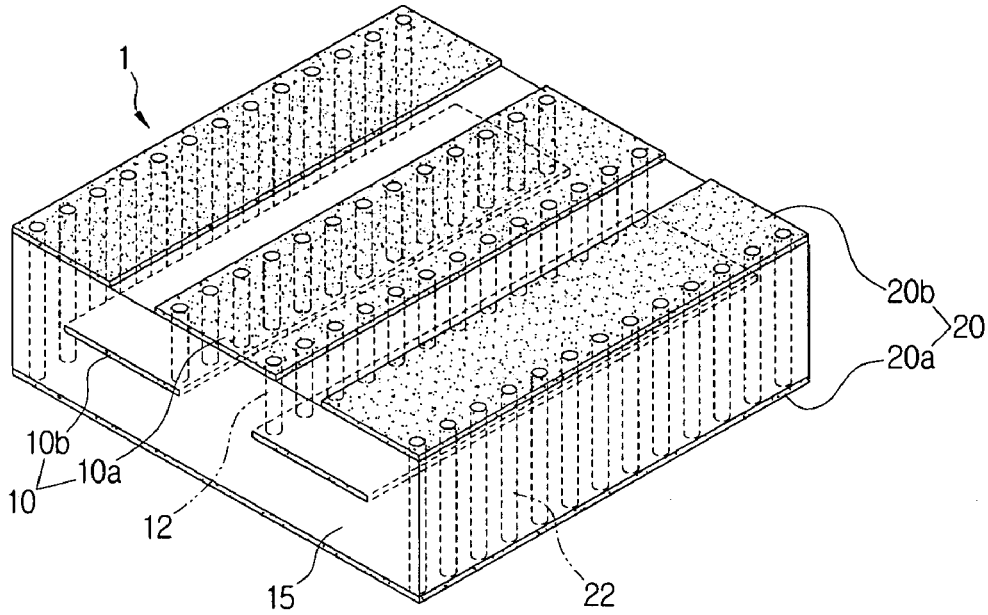
FIG. 1 is a perspective view of a patch antenna for local area communications according to one embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention with unnecessary detail.

A patch antenna for local area communications according to an embodiment of the present invention is used for short-distance communications with directionality similar to an RFID antenna mounted in a mobile communication terminal. The patch antenna is applicable to various communication devices, such as wireless routers, for the short-distance communications.

Figure 2:
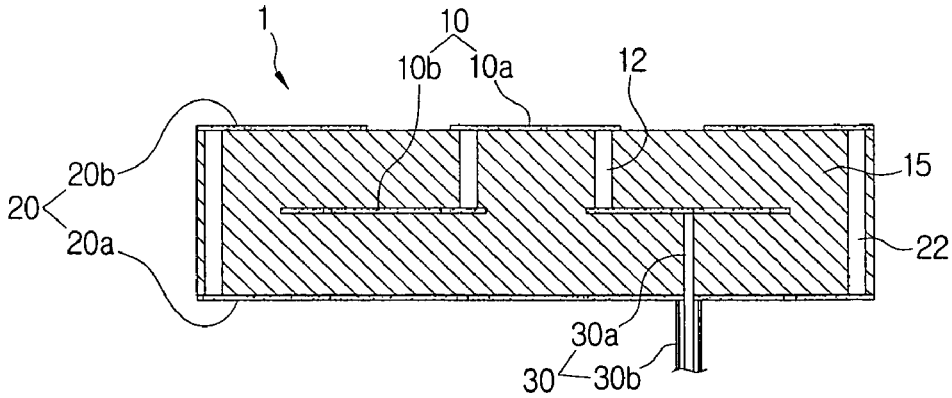
FIG. 2 is a cross-sectional view of the patch antenna of FIG. 1.

FIG. 1 is a perspective view of a patch antenna for local area communications according to one embodiment of the present invention, and FIG. 2 is a cross-sectional view of the patch antenna of FIG. 1.

The patch antenna 1 for the local area communications comprises a dielectric 15, a ground part 20, and a radiator part 10.

The dielectric 15 is hexahedral in shape. A pair of surfaces facing each other are wider than other surfaces. Herein, the pair of the wider surfaces is referred to as an upper surface and a bottom surface of the dielectric 15, respectively.

The ground part 20 comprises a first ground 20*a* on the bottom surface of the dielectric 15, and a pair of second grounds 20*b* on the upper surface of the dielectric 15. The first ground 20*a* and the pair of second grounds 20*b* are formed using conducting plates.

The first ground 20*a* may be a rectangular plate of the same size as the dielectric 15 and attached on the bottom surface of the dielectric 15. The pair of second grounds 20*b* are a pair of conducting plates and are rectangular. Specifically, the pair of second grounds 20*b* are rectangular in shape, with one side which is as long as one side of the dielectric 15. The pair of second grounds 20*b* are disposed at a pair of corners facing each other on the upper surface of the dielectric 15.

The first ground 20*a* and the pair of second grounds 20*b* are electrically interconnected to each other through via holes 22. The via holes 22 penetrate through the dielectric 15 in an area adjacent to the corner of the dielectric 15 of the pair of second grounds 20*b*, and extend to the first ground 20*a*. A plurality of via holes 22 are formed perpendicular to the pair of second grounds 20*b*.

The radiator part 10 comprises a first radiator 10*a* attached on the upper surface of the dielectric 15, and a pair of second radiators 10*b* inserted into the dielectric 15. The first radiator 10*a* and the second radiators 10*b* are electrically connected to each other.

The first radiator 10*a* is attached between the pair of the second grounds 20*b* at the center of the upper surface of the dielectric 15. The first radiator 10*a* is spaced away from the pair of second grounds 20*b* at a certain distance. The length of the first radiator 10*a* is equal to the length of the pair of second grounds 20*b*. Note that the length of the first radiator 10*a* varies according to the design.

The pair of second radiators 10*b* are inserted to the middle area between the upper surface and the bottom surface of the dielectric 15. The second radiators 10*b* form a pair of conducting plates in the dielectric 15, which are positioned in areas corresponding to either side of the first radiator 10*a*. In other words, the second radiators 10*b* are positioned in the dielectric 15 between the first radiator 10*a* and the second ground 20*b*.

The first radiator 10*a* and the second radiators 10*b* are electrically connected to each other through a pair of via holes 12. The via holes 12 are formed between a pair of end regions of the first radiator 10*a* facing the pair of second grounds 20*b*, to an end region of the pair of second radiators 10*b* facing the first radiator 10*a*. A plurality of the via holes 12*a* are arranged in a line along the longitudinal direction of the first radiator 10*a* and the second radiators 10*b*.

A coaxial cable 30 is coupled to one side of the patch antenna 1, which supplies power to the ground part 20 and the radiator part 10. An external probe 30*b* supplies the power to the ground part 20, and an internal probe 30*a* provides the power to the radiator part 10.

Descriptions are now provided for fabrication of the patch antenna 1.

First, two dielectrics are prepared, which are half of the height of the dielectric 15. The first radiator 10*a* and the pair of second grounds 20*b* are printed on the upper surface of the one dielectric, and the pair of second radiators 10*b* are printed on the bottom surface. The first radiator 10*a* is connected to each of the second radiators 10*b* through the via holes 12.

The first ground 20*a* is printed on the bottom surface of the other dielectric.

Next, the dielectrics are attached to each other and the first ground 20*a* is connected to each of the second grounds 20*b* through the via holes 22.

Figure 3:
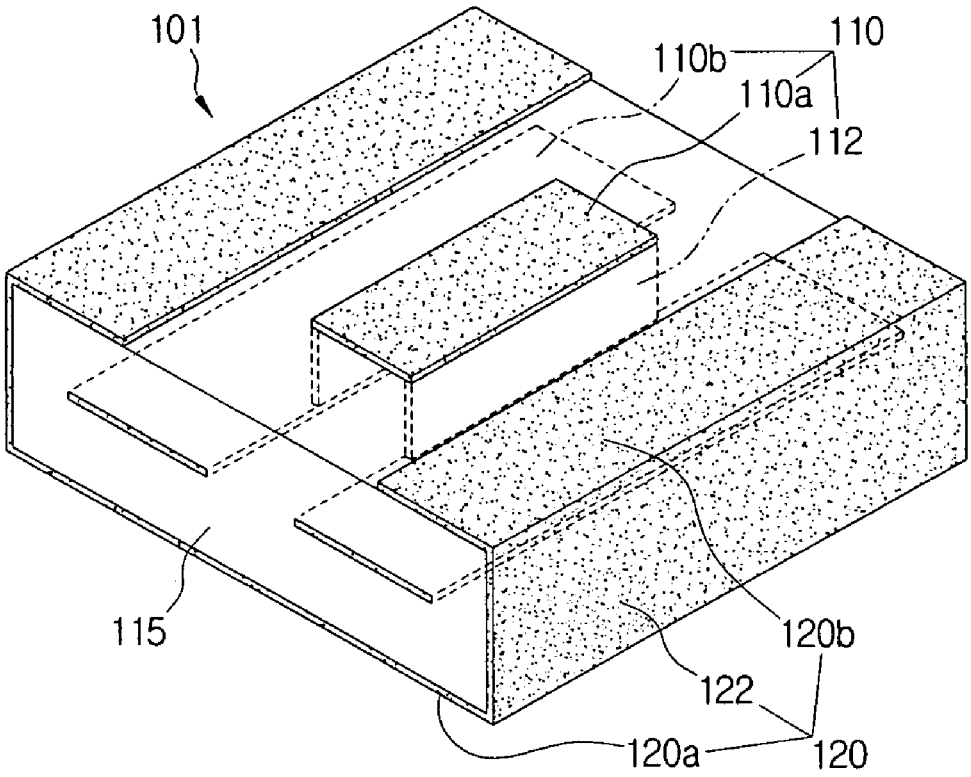
FIG. 3 is a perspective view of a patch antenna for local area communications according to another embodiment of the present invention.

FIG. 3 is a perspective view of a patch antenna for local area communications according to another embodiment of the present invention.

According to another embodiment of the present invention, a ground part 120 of the patch antenna 101 is structured similar to the patch antenna 1 in that a pair of second grounds 120*b* is disposed on an upper surface of a dielectric 115 and a first ground 120*a* is disposed on a bottom surface of the dielectric 115. Notably, the ground part 120 further comprises a connection part 122, which is formed using a conducting plate and attached to a side of the dielectric 115, to interconnect the first ground 120*a* and the second grounds 120*b*, respectively. Specifically, the first ground 120*a*, the pair of second grounds 120*b*, and the connection part 122 are integrally formed in the ground part 120 by bending both ends of the single conducting plate two times.

Similarly to the ground part 120, a radiator part 110 interconnects a first radiator 110*a* and a pair of second radiators

110*b* using a conducting plate 112. The first radiator 110*a* is smaller than the second radiator 110*b* in size.

With the patch antenna 1 or 101 constructed as shown in FIGS. 1, 2, and 3, the length and width of the patch antenna 1 or 101 can each be about 3 cm, whereas the sizes of the radiator part and the ground part of the conventional patch antenna are each greater than 6 cm. That is, the size of the patch antenna 1 or 101 can be halved.

Figure 4A:
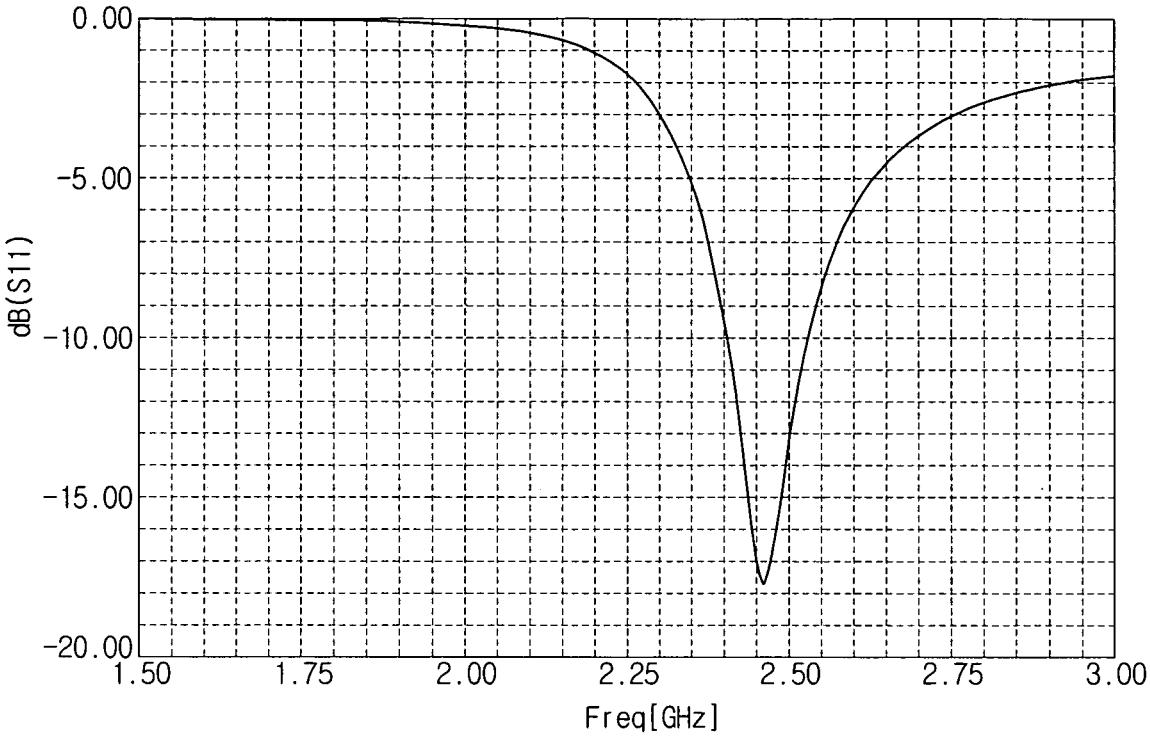
FIG. 4A is an S11 graph when the patch antenna of FIG. 1 is designed by matching to the 2.45 GHz band.
Figure 4B:
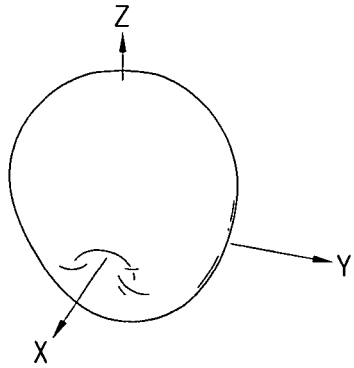
FIG. 4B is a radiation pattern when the patch antenna of FIG. 1 is designed by matching to the 2.45 GHz band.

FIG. 4A is an S11 graph illustrating when the patch antenna of FIG. 1 is designed by matching to the 2.45 GHz band, and FIG. 4B is a radiation pattern when the patch antenna of FIG. 1 is designed by matching to the 2.45 GHz band.

Referring to FIG. 4A, the center frequency of the patch antenna 1 is 2.46 GHz, the frequency bandwidth at −5 dB is 284 MHz, the frequency bandwidth at −10 dB is 125 MHz, and the gain is 3.96 dB. While this result is on the same level as a related art patch antenna for the RFID, the frequency bandwidth is wider than the general patch antenna.

Referring to FIG. 4B, the radiation pattern of the patch antenna 1 shows the radiation concentrated in the (+) direction of the Z axis. This implies the patch antenna 1 has directionality.

This radiation pattern is acquired from experiments using the patch antenna 1 per se. If the patch antenna 1 is attached to a circuit board of a mobile communication terminal or to the ground part 20, its directionality will increase.

Figure 5A:
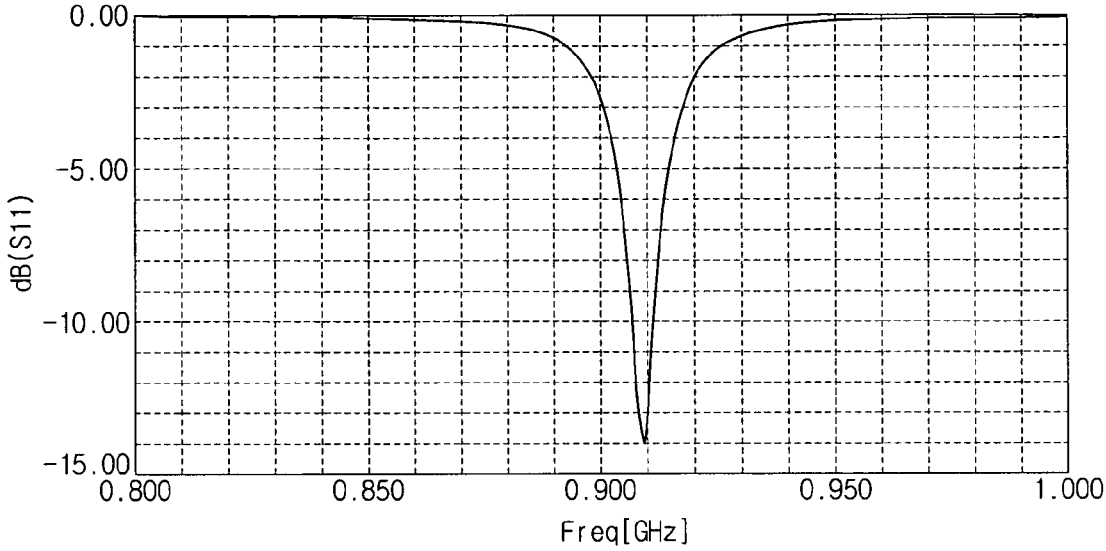
FIG. 5A is an S11 graph when the patch antenna of FIG. 3 is designed by matching to 910 MHz.
Figure 5B:
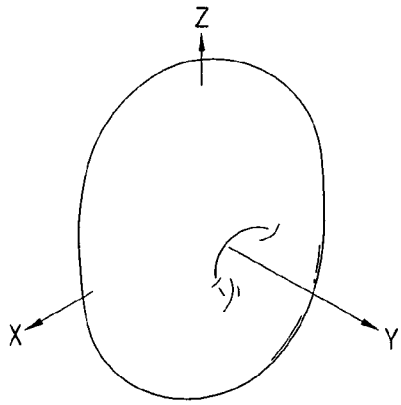
FIG. 5B is a radiation pattern when the patch antenna of FIG. 3 is designed by matching to 910 MHz.

FIG. 5A is an S11 graph when the patch antenna of FIG. 3 is designed by matching to 910 MHz, and FIG. 5B is a radiation pattern when the patch antenna of FIG. 3 is designed by matching to 910 MHz.

As shown in FIG. 5A, the center frequency of the patch antenna 101 is 910 MHz, the frequency bandwidth at −5 dB is 10 MHz, the frequency bandwidth at −10 dB is 4 MHz, and the gain is 1.02 dB. This result shows that the patch antenna 101 can serve as the RFID antenna in 910 MHz band.

In FIG. 5B, the radiation pattern of the patch antenna 101 shows the shortened width along the Y axis and the extended width along the Z axis. In other words, the radiation along the Y axis is less and the radiation along the Z axis is greater. This implies the patch antenna 101 has directionality.

With the patch antenna 1 or 101 as constructed above, since the ground part 20 or 120 is formed on the upper surface and the bottom surface of the dielectric 15 or 115, the size of the ground part 20 or 120, which primarily caused the enlargement of the patch antenna 1 or 101, can be drastically reduced. Also, since part of the radiator part 10 or 110 is disposed on the upper surface of the dielectric 15 or 115 and the rest of the radiator part 10 or 110 is disposed within the dielectric 15 or 115, it is possible to reduce the area occupied by the radiator 10 or 110 and enhance the radiation efficiency by the presence of the first radiator 10*a* or 110*a* on the upper surface of the dielectric 15 or 115.

Therefore, the patch antenna 1 or 101 has far more reduced size, and wide bandwidth and high gain as shown in FIGS. 4A and 5A. As illustrated in FIGS. 4B and 5B, the patch antenna 1 or 101, which has directionality, is suitable for RFID antennas mounted in the mobile communication terminal or wireless routers.

In light of the foregoing, the size of a patch antenna can be drastically reduced, and the patch antenna can acquire a wide bandwidth, high gain, and directionality.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A patch antenna comprising:

a radiator part which comprises at least one first radiator attached to an area of one surface of a dielectric, and at least one second radiator disposed within the dielectric and electrically connected to the first radiator; and a ground part which comprises at least one first ground disposed on another surface of the dielectric and at least one second ground disposed on the one surface of the dielectric, wherein, the first ground and the second ground are electrically connected to each other and the second radiator comprises a pair of conducting plates on either side of the first radiator.

2. The patch antenna as in claim 1, wherein the first radiator and the second radiator are electrically connected to each other through at least one via hole.

3. The patch antenna as in claim 2, wherein each of the at least one via hole connects an end region of the first radiator facing the second ground to an end region facing the first radiator of the conducting plates which construct the second radiator.

4. The patch antenna as in claim 1, wherein the first ground and the second ground are electrically connected to each other through at least one via hole.

5. The patch antenna as in claim 4, wherein the at least one via hole connects both end regions of the first ground to an outer end region of the conducting plates which construct the second ground.

6. The patch antenna as in claim 1, wherein the first radiator is disposed at a center area of the one side of the dielectric.

7. The patch antenna as in claim 1, wherein the size of the first ground corresponds to the other surface of the dielectric.

8. The patch antenna as in claim 1, wherein the second ground comprises a pair of conducting plates which are spaced at a certain distance from the first radiator and are disposed on both sides of the first radiator.

9. The patch antenna as in claim 1, wherein the radiator part and the ground part each receive power from probes.

10. The patch antenna as in claim 1, wherein the first radiator and the second radiator are electrically connected to each other through a conducting plate.

11. The patch antenna as in claim 1, wherein the first ground and the second ground are electrically connected to each other through a conducting plate.

12. The patch antenna as in claim 11, wherein the first ground, the second ground and the conducting plate are integrally formed.

13. The patch antenna as in claim 1, wherein the second ground is rectangular in shape with one side having the same length as a side of the dielectric.

14. The patch antenna as in claim 1, wherein a coaxial cable is coupled to the radiator part and the ground part.

15. The patch antenna as in claim 14, wherein the coaxial cable comprises an external probe which supplies power to the ground part and an internal probe which provides power to the radiator part.

16. A patch antenna comprising:

a radiator part which comprises at least one first radiator attached to an area of one surface of a dielectric, and at least one second radiator disposed within the dielectric and electrically connected to the first radiator; and a ground part which comprises at least one first ground disposed on another surface of the dielectric and at least one second ground disposed on the one surface of the dielectric, wherein, the first ground and the second ground are electrically connected to each other and the second ground comprises a pair of conducting plates which are disposed on both sides of the first radiator.

17. A patch antenna comprising:

a radiator part which comprises at least one first radiator attached to an area of one surface of a dielectric, and at least one second radiator disposed within the dielectric and electrically connected to the first radiator; and a ground part which comprises at least one first ground disposed on another surface of the dielectric and at least one second ground disposed on the one surface of the dielectric, wherein the first ground and the second ground are electrically connected to each other; and the first radiator is disposed at a center area of the one side of the dielectric.

* * * * *